US007704194B1

(12) United States Patent
Chen

(10) Patent No.: US 7,704,194 B1
(45) Date of Patent: Apr. 27, 2010

(54) BOXING EQUIPMENT

(76) Inventor: Yi-Lin Chen, 3F.-5, No. 262, Sec. 2, Henan Rd., Situn District, Taichung City 407 (TW)

( * ) Notice: Subject to any disclaimer, the term of this patent is extended or adjusted under 35 U.S.C. 154(b) by 0 days.

(21) Appl. No.: 12/388,523

(22) Filed: Feb. 19, 2009

(51) Int. Cl.
*A63B 69/22* (2006.01)

(52) U.S. Cl. ..... 482/87; 482/83; 482/90

(58) Field of Classification Search ..... 482/83–90; 472/441, 442, 443, 444, 445
See application file for complete search history.

(56) References Cited

U.S. PATENT DOCUMENTS 5,330,403 A * 7/1994 Kuo ..... 482/83
5,674,157 A * 10/1997 Wilkinson ..... 482/83
5,921,895 A * 7/1999 Lynch et al. ..... 482/83
6,390,958 B1 * 5/2002 Chu ..... 482/90

* cited by examiner

*Primary Examiner*—Jerome Donnelly
(74) *Attorney, Agent, or Firm*—Banger Shia

(57) ABSTRACT

A boxing equipment of the present invention includes a base, a disc member, a plastic pole, a boxing member and a sheath. The disc member is disposed on the base for housing a first end of a resilient member, and the pole is fastened to a second end of the resilient member. One end of the pole is mounted with the boxing member, while the sheath can fasten the boxing member with the pole.

9 Claims, 5 Drawing Sheets

BOXING EQUIPMENT

BACKGROUND OF THE INVENTION

1. Field of the Invention

The present invention relates to a boxing equipment, in which a boxing member thereof can securely fastened with a pole and can be stored easily.

2. Description of the Prior Art

As disclosed in the Taiwan Patent Pub. No. 228723, a conventional boxing equipment includes a base having a central pole, and includes a cylindrical boxing body having a central bore, in which the boxing body is a pneumatic inflatable plastic bag. When fully stored with air, the boxing body can house the central pole in the central bore. However, the boxing body slides off the pole bit by bit when it is constantly punched by the user, which cannot satisfy the training purpose.

An improved boxing equipment is provided as disclosed by the U.S. Pat. No. 6,106,443, which also includes a base having a central pole, and includes a boxing body. The central pole and an interior of the boxing body are both made of plastic foam for a better positioning performance, yet still causing another problem that the boxing body cannot be easily stored like the conventional inflatable boxing body does.

SUMMARY OF THE INVENTION

The main object of the present invention is to provide a boxing equipment that can be easily stored.

Another object of the present invention is to provide a boxing equipment whose boxing member can be securely fastened while punched by the user.

To achieve the above objects, a boxing equipment which includes a base, a disc member, a resilient member, a plastic pole, a boxing member and a sheath is provided. The base is filled with liquid fluid, and the disc member, which is disposed on the base, is for housing a first end of the resilient member. In addition, the pole has a first end and a second end. The first end of the pole is fastened to a second end of the resilient member, and the second end of the pole is mounted with the boxing member. The boxing member has an air chamber and a mounting chamber. When the air chamber is fully stored with air, the mounting chamber tightly receives one end of the pole therein, and the sheath further covers the boxing member and receives a rim of the pole therein, so as to facilitate the boxing training.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
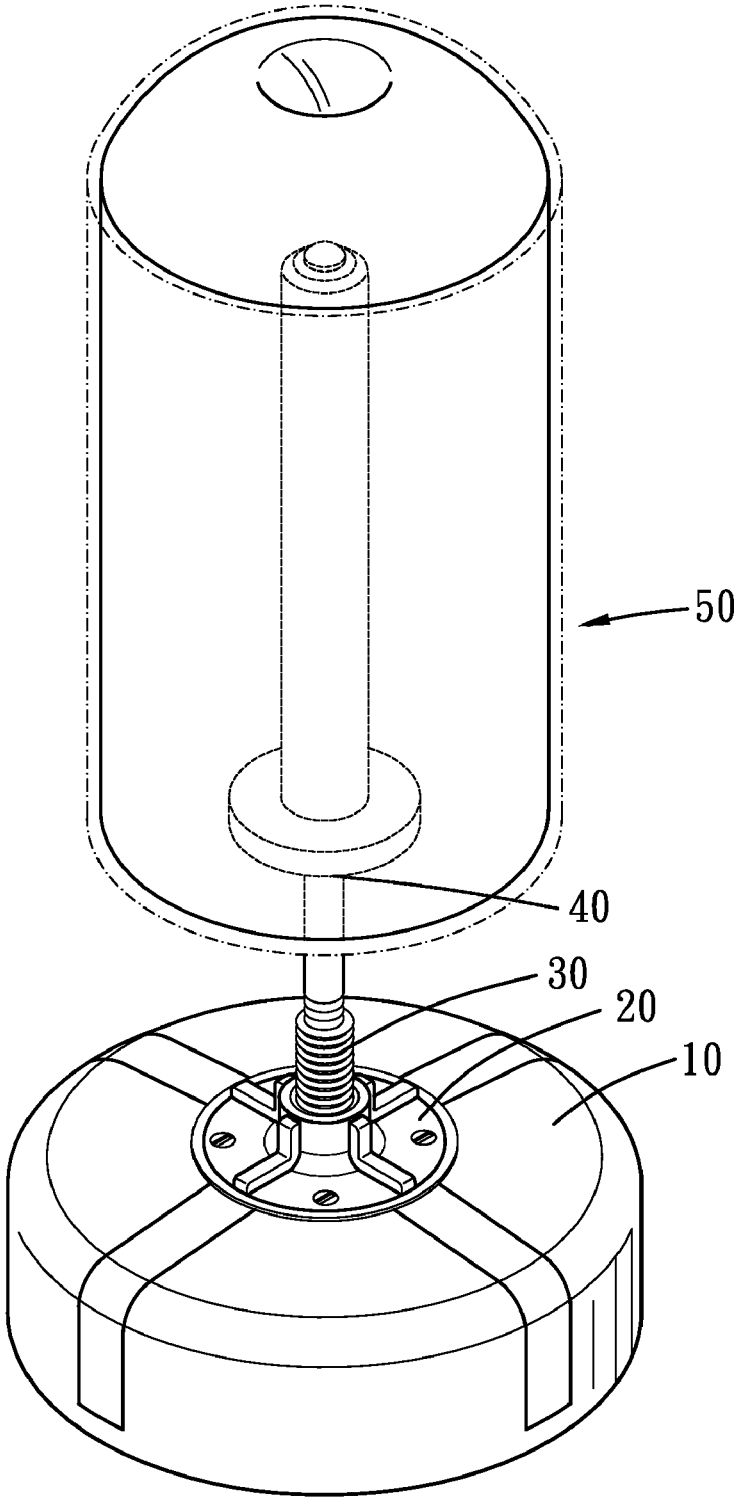
FIG. 1 is a schematic drawing showing a preferred embodiment of the present invention.
Figure 2:
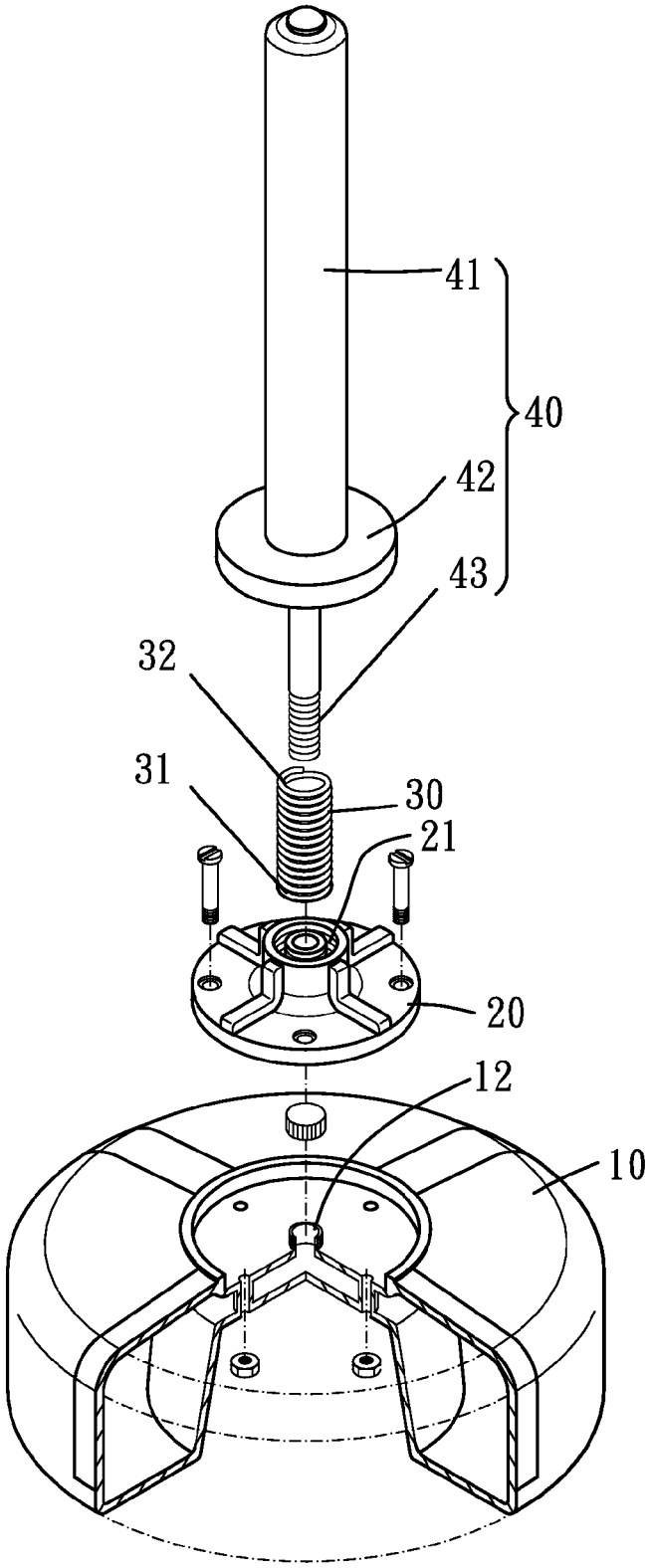
FIG. 2 is an exploded drawing showing the preferred embodiment of the present invention.
Figure 3:
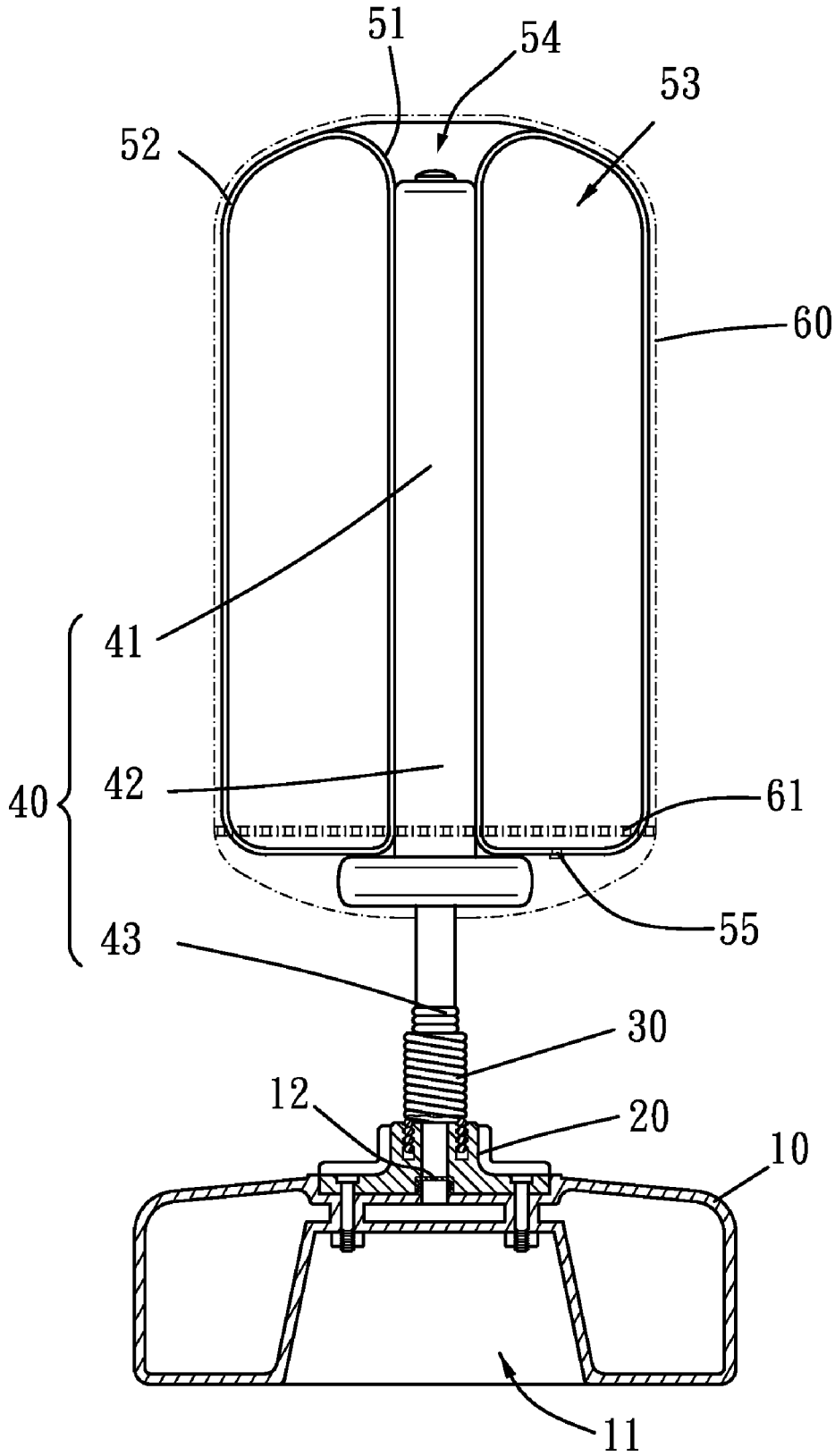
FIG. 3 is a cross-sectional view of the preferred embodiment of the present invention.
Figure 4:
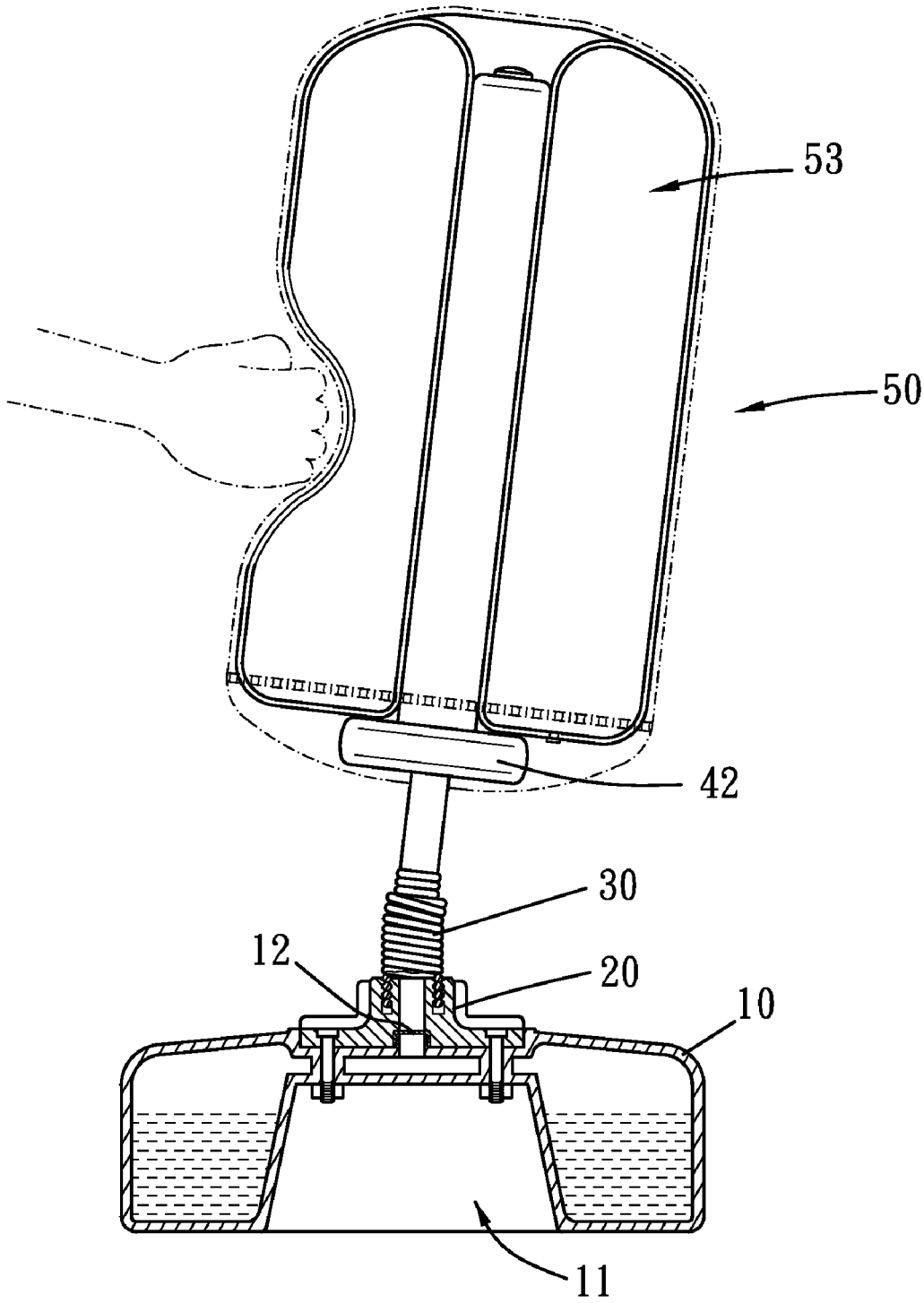
FIG. 4 is a cross-sectional view of the preferred embodiment of the present invention when punched by a fist.

Please refer to FIG. 1 to FIG. 4. A boxing equipment of the present invention includes a base 10, a disc member 20, a resilient member 30, a pole 40, a boxing member 50 and a sheath 60.

The base 10 is a hollow cylindrical body, and a bottom surface thereof is formed with a concave receiving space 11. A top surface of the base 10 is formed with a round pit having a central stuffing hole 12 for liquid fluid i.e. water to be filled into an interior hollow space of the base 10 through the stuffing hole 12, such that the base 10 can stand still. Furthermore, the disc member 20 is fixed in the round pit in a screwed manner, and the nuts mate with the screws in the concave receiving space 11. On a top surface of the disc member 20 is provided with a socket 21, and an inner threaded section is formed on a side wall of the socket 21 to engage with the resilient member 30.

The resilient member 30 is a metallic spring, and an inner threaded portion and an outer threaded portion are defined around an inner periphery and an outer periphery of the metallic spring respectively. The outer threaded portion of a first end 31 of the resilient member 30 is directly mated with the inner threaded section of the socket 21. The pole 40 has a first end and a second end. And, the second end 32 of the resilient member 30 is fastened to the first end of the pole 40 which is formed in a hollow cylindrical shape and is manufactured in a plastic blow molding manner. More specifically, an outer threaded section is formed on the first of the pole 40 to mate the inner threaded portion of the resilient member 30. In addition, the second end of the pole 40 is a mounting end 41 to mount with the boxing member 50.

The boxing member 50 includes an inner bag surface 51 and an outer bag surface 52, and a diameter of the outer bag surface 52 is bigger than that of the inner bag surface 51. An air chamber 53 is defined between the inner bag surface 51 and the outer bag surface 52, and a mounting chamber 54 is defined within the inner bag surface 51. The mounting chamber has a first end and a second end. At least one of the first and second ends of the mounting chamber 54 has an opening to receive the mounting end 41 in the mounting chamber 54. Moreover, a rim 42 is formed on a portion of the pole 40, which is adjacent to the opening of the mounting chamber 54, and a diameter of the rim 42 is bigger than an inner diameter of the opening for positioning purpose. On a bottom surface of the boxing member 50 is disposed an air stuffing bore 55.

The sheath 60 covers the boxing member 50, and a fastening means is defined on the sheath 60 to fasten the pole 40 with the boxing member 50. The sheath 50 includes an upper portion and a bottom portion, and the fastening means includes a zipper 61 to fasten the upper portion with the bottom portion, and the bottom portion has a central opening for the pole to pierce therethrough. An inner diameter of the central opening of the bottom portion is smaller than the outer diameter of the rim 42, therefore the sheath 60 also receives the rim 42 therein. When the air chamber 53 is fully stored with air, the inner bag surface 52 tightly surrounds a periphery of the mounting end 41, such that the mounting end 41 is securely engaged in the mounting chamber 54. The air stuff bore 55 can be disposed in the sheath 60 or out of the sheath 60 for the user to stuff air into the air chamber 53.

Figure 5:
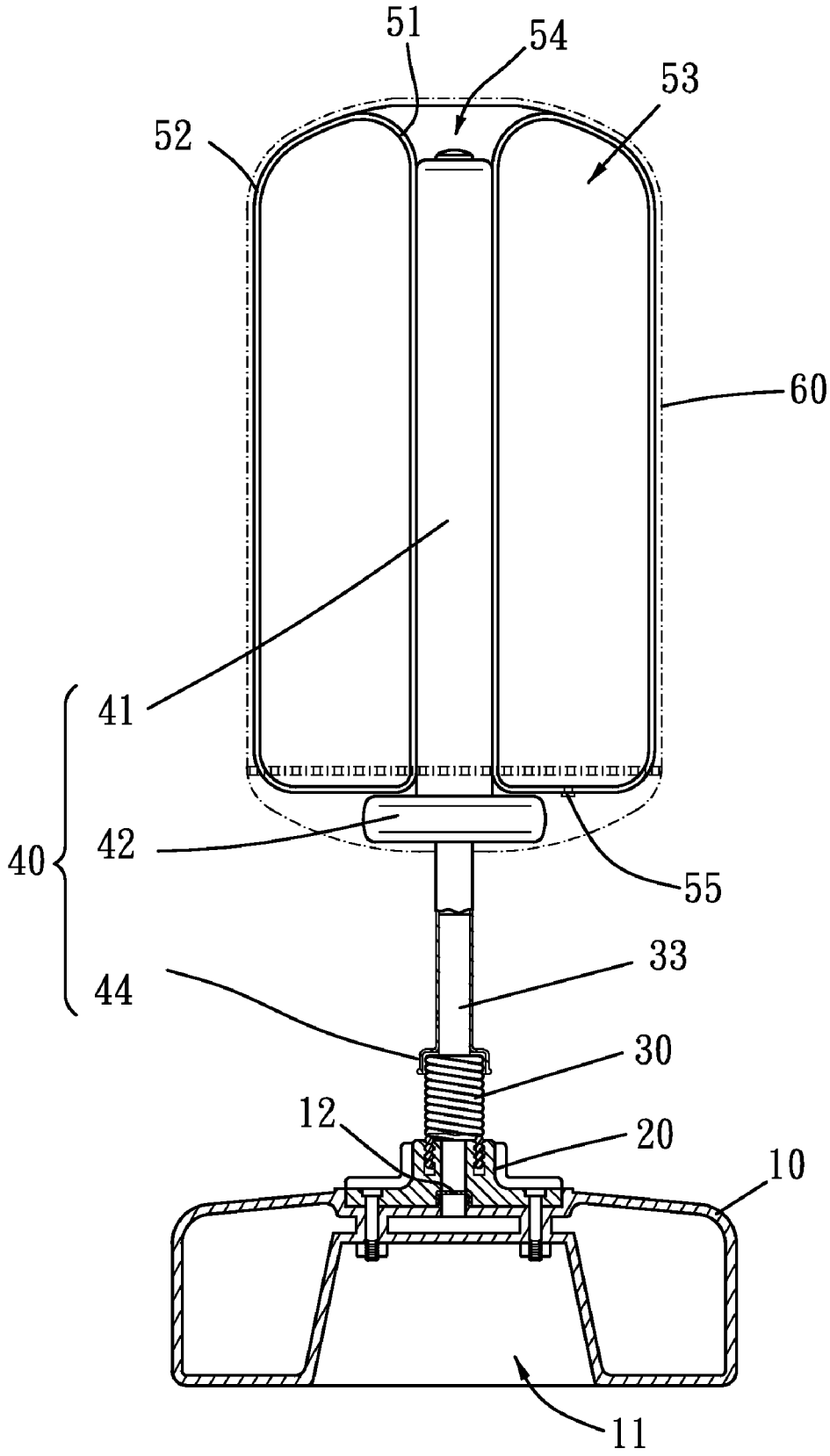
FIG. 5 is a cross-sectional view of another embodiment of the present invention.

Refer to FIG. 5 for another embodiment of the present invention. A metallic tube 33 is welded on the second end 32 of the resilient member 30 to pierce into an interior of the pole 40 for positioning purposes. A cover 44 is provide on the end of the pole 40 close to the resilient member 30 to cover the metallic tube 33 and protect it from being directly hit.

The fastening means of the sheath 60 can includes a shrink band, instead of the zipper, disposed around an opening of the sheath 60 to constrict the opening of the sheath 60, such that an inner diameter of the opening of the sheath 60 is selectively smaller or bigger than the diameter of the rim 42 to receive the pole 40 in the sheath 60 for positioning purposes. In addition, the pole 40 consists of multiple sub-poles, which can be assembled with each other and is convenient to be stored and transported. Furthermore, the concave receiving space 11 can be used for storing the deflated boxing member 50, which is also a convenient and smart way of housing.

What is claimed is:

1. Boxing equipment comprising a base a boxing member;

a resilient member having a first end and second end;

a disk member disclosed on the base; the disc member having a socket housing the first end of said resilient member;

a plastic pole having first end and a second end, the plastic pole, having the first end of the pole fastened to the second end of the resilient member, the second end of the pole being mounted to the boxing member, wherein the boxing member comprises an inner bag surface and an outer bag surface having a diameter, the diameter of the outer bag surface being larger than that of the inner bag surface, an air chamber defined between the inner bag surface and the outer bag surface, and a mounting chamber having ends defined within the inner bag surface, and at least one end of the mounting chamber having an opening having a diameter to receive an end of the pole in the mounting chamber, a rim having a diameter formed in a portion of the pole, adjacent to an opening of the mounting chamber, said diameter of the rim being larger than the diameter of the opening of the mounting chamber for positioning purposes; and a sheath covering the boxing member and receiving the rim therein, and;

a fastening means defined on the sheath fastening the pole with, the boxing member;

wherein when the air chamber is fully filled with air the inner bag surface tightly surrounds a periphery of the mounting end wherein the mounting end is securely engaged in the mounting chamber.

2. The boxing equipment of claim 1, wherein the sheath comprises an upper portion and a bottom portion, the fastening means comprises a zipper to fasten the upper portion with the bottom portion, and the bottom portion has an opening for the pole to pierce therethrough.

3. The boxing equipment of claim 1, wherein the resilient member is a metallic spring, and an inner threaded portion and an outer threaded portion are defined around an inner periphery and an outer periphery of the metallic spring respectively, the pole is formed in a hollow cylindrical shape, and an outer threaded section is formed on one end of the pole to mate the inner threaded portion of the metallic spring.

4. The boxing equipment of claim 3, wherein an inner threaded section is formed on a side wall of the socket to mate the outer threaded portion of the metallic spring.

5. The boxing equipment of claim 4, wherein a concave receiving space is formed on a bottom surface of the base.

6. The boxing equipment of claim 5, wherein the pole is manufactured blow molding, and the pole consists of multiple sub-poles.

7. The boxing equipment of claim 1, wherein a metallic tube is welded on the second end of the resilient member to pierce into an interior of the pole for positioning purposes.

8. The boxing equipment of claim 1, wherein the base is filled with a liquid fluid.

9. The boxing equipment of claim 1, wherein the fastening means comprises a shrink band disposed around an opening of the sheath to constrict the opening of the sheath, such that an inner diameter of the opening of the sheath is selectively smaller or bigger than the diameter of the rim.

* * * * *